United States Patent [19]

Tallmadge et al.

[11] 4,009,359

[45] Feb. 22, 1977

[54] METHOD AND APPARATUS FOR CONTROLLING MICROWAVE OVENS

[75] Inventors: Gene E. Tallmadge, Palo Alto; John E. Gerling, San Mateo, both of Calif.

[73] Assignee: Chemetron Corporation, Chicago, Ill.

[22] Filed: Nov. 7, 1975

[21] Appl. No.: 629,915

[52] U.S. Cl. ..... 219/10.55 B; 219/10.55 M; 324/95

[51] Int. Cl.[2] ..... H05B 9/06

[58] Field of Search ..... 219/10.55 B, 10.55 M, 219/10.55 R; 324/94, 106, 95; 73/190 EW

[56] References Cited

UNITED STATES PATENTS

| | | | |
|---|---|---|---|
| 3,665,140 | 5/1972 | White | 219/10.55 B |
| 3,710,065 | 1/1973 | Crapuchettes | 219/10.55 B |
| 3,875,361 | 4/1975 | Fukui et al. | 219/10.55 B |

*Primary Examiner*—Arthur T. Grimley
*Attorney, Agent, or Firm*—N. M. Esser

[57] ABSTRACT

A method and apparatus is disclosed for controlling the temperature rise of a material placed in a microwave oven in which use is made of a correlation between the power delivered to the load and the residual field within the oven at a position spaced away from the load. By sensing the strength of the electromagnetic field, electronic circuitry is provided for evaluating the time required to achieve a given temperature rise of the material being heated.

5 Claims, 5 Drawing Figures

| v | $P_L$ | E |
|---|---|---|
| 0 | 5333 | 73.03 |
| .025 | 4571 | 68.74 |
| .05 | 4000 | 65.36 |
| .1 | 3200 | 60.26 |
| .15 | 2667 | 56.62 |
| .2 | 2286 | 53.78 |
| .3 | 1778 | 49.94 |
| .4 | 1455 | 47.23 |
| .6 | 1066.7 | 43.90 |
| .8 | 842.1 | 41.69 |
| 1.0 | 695.7 | 40.21 |

TABLE I

METHOD AND APPARATUS FOR CONTROLLING MICROWAVE OVENS

BACKGROUND OF THE INVENTION

This application relates to a method and apparatus for controlling microwave ovens and particularly to such method and apparatus for controlling the time interval of operation of a microwave oven to achieve a desired temperature within a load material such as food placed within the oven.

Heretofore, several approaches to oven control have been utilized. For example, it is common to utilize a timer which is set by the oven operator based on past experience with a given food. This often leads to error because of the amount of power delivered to a given amount of food varies with its character, quantity, and starting temperature. These are factors which are difficult for the operator to assess. Approaches to solving this problem include approximating the degree of temperature rise in food by various procedures such as incorporating a cooperative or analog element with the food which heats at roughly the same rate and, therefore, can give an indication of the temperature at which the food has achieved. An example of such a system is disclosed in U.S. Pat. No. 3,854,022, issued Dec. 10, 1974, to Donald G. Moore, and entitled "Electromagnetic Oven System for Automatically Heating Variable Numbers and Sizes of Food Items or the Like", in which a ferrite element is incorporated in a food tray, the element being selected to have a Curie transition temperature corresponding to the desired temperature of the food so that upon crossing the Curie temperature the ferrite loses its magnetic properties. This is sensed by suitable magnetic circuit for shutting the oven off. Other systems have included measuring the temperature of the food directly with a pyrometer; measuring the temperature of an associated substance of similar or relatable character; measuring the heat of air or the amount of water vapor coming off the food being heated; and the inclusion of a thermometer probe in the food itself. These systems are generally cooperative in that they sense directly the temperature of the food or measure a property of a material which is an analog of the food. However, they each suffer from certain disadvantages. The utilization of temperature sensors has been found not only expensive, but somewhat unreliable while the direct insertion of a thermal measuring device is impractical, particularly where repetitive use of the oven is required. The use of analog devices permanently installed in the oven involves thermal hysteresis since the analog device may not begin at the same temperature in any given heating cycle. The utilization of a ferrite analog of the food works well in those applications requiring the utilization of a food tray such that the ferrite is at the same starting temperature as the food, as in various institutional environments (i.e., hospitals, inflight meal service). However, for more general applications and, particularly in applications wherein different types and quantities of foods are dispensed from a vending machine for re-thermalization, the expense of providing an analog element at the same temperature as the food during each heating cycle becomes a considerable disadvantage. There is, therefore, a need for a new and improved system for controlling microwave ovens in the heating of foods.

In the present discussion, particular reference will be had to the heating of foods by example; and the models and descriptions given herein will be especially applied to the re-thermalization of previously prepared foods. In certain portions of the present discussion, food equivalent will be represented by given amounts of water. It should be understood, however, that the term — food (or water)— as used herein refers to such by way of specific analysis and example, but the term also includes any material which is heatable in a microwave oven. And, the term -heating- should be taken to include not only re-thermalization of such materials by way of example, but to also include the cooking of the same.

SUMMARY OF THE INVENTION AND OBJECTS

In general, it is an object of the present invention to provide a method and apparatus for controlling microwave ovens which will overcome the above limitations and disadvantages.

A further object of the invention is to provide a method and apparatus of the above character which is non-cooperative in character but which is capable of sensing the quantity of food present in a microwave oven and thereby controlling the length of time the oven must be on to achieve a given degree of heating.

Another object of the invention is to provide a method and apparatus of the above character which does not require the addition of an analog element with the food.

Another object of the invention is to provide a method and apparatus of the above character which directly utilizes the electromagnetic field conditions within the microwave oven to sense the quantity and type of food contained in the oven and to use that information to establish the oven operation time interval to achieve the required degree of heating.

Another object of the invention is to provide a method and apparatus of the above character which operates with electronic circuits.

Another object of the invention is to provide a method and apparatus of the above character which also provides for oven turn-off whenever a no-load or an excess on-time condition occurs.

Another object of the invention is to provide a method and apparatus of the above character which is user convenient in that the user need only dial the initial input temperature of the food and the desired final temperature, the oven control system of the present invention serving to automatically compensate for the quantity to achieve the selected final temperature.

In order to understand the present invention, it will be necessary to review certain assumptions regarding the operation of microwave ovens, to analyze the operating parameters of microwave ovens, and to observe the possibility of a correlation in these properties which directly relates the quantity of heatable substance of the food in the oven from measurements of the oven's electromagnetic field so as to provide a basis for controlling the time during which the oven is on to achieve a desired degree of heating. It will be convenient, therefore, to introduce here an analysis of the oven conditions before proceeding with the specific description of the invention itself. For this purpose, we now refer to the following drawings of which:

Figure 1:
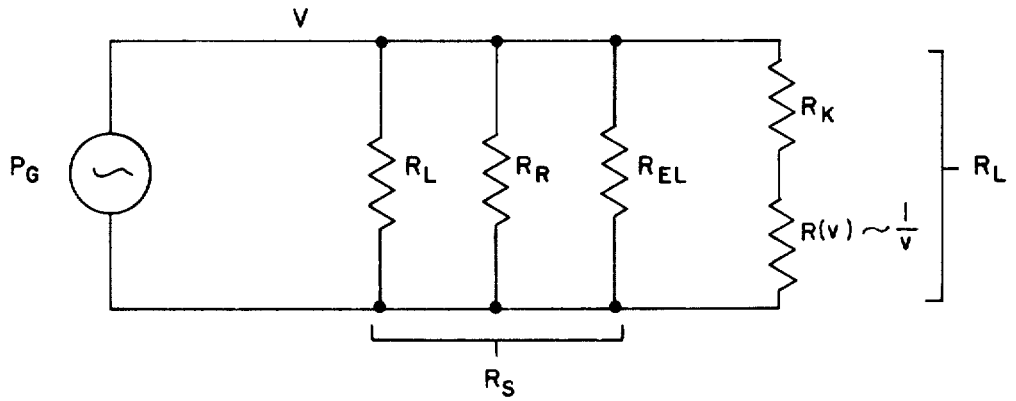
FIG. 1 is a simplified electrical circuit representation of microwave oven load characteristics.

The cavity of a microwave oven is multi-mode in character and can be represented by a constant power generator indicated as $P_G$ in FIG. 1, feeding several resistors in parallel. Each element of load is represented as a separate resistance and can be summarized as follows: $R_C$ accounts for the loss in cavity walls, rollers, mode stirrers, and other elements within the cavity. $R_R$ represents reflected power while $R_{EL}$ accounts for the power consumed in end loads if any. $R_L$ is associated with the useful power transmitted to the load and is made up of two elements in series, $R_K$ and $R(v)$, where $R(v)$ is the quantity related portion of the load resistance. It is justified to assume that the load resistance $R(v)$ is inversely proportional to the quantity of load so that $R(v)$ can be normalized and set equal to $1/v$ where $v$ is the volume of the load in equivalent liters of water. $R_K$ is required because if a volume $v$ were very large, $R(v)$ would be so small that it, compared to the remaining shunt resistances, would imply an efficiency approaching 100%. This is not realistic for many reasons, one of which is the finite depth of penetration of microwaves into a physically large body of material. Thus, $R_K$ is required in any realistic model in order to place an asmyptotic upper limit to cavity efficiency. From inspection of FIG. 1, the foregoing resistances can be lumped into or modeled as a shunt resistance $R_S$ in parallel with the series resistance that is $R_K$ and $1/v$.

The relative values of these resistances can be found by experiment. It is convenient to normalize the schematic model relative to liters of water, such being used in the following discussion, i.e. $v$ represents the amount of load in equivalent liters of water. As a practical matter, for commonly used microwave ovens in rethermalization applications, $v$ varies from 0 (no load) to about a maximum of about 1 liter of water.

Efficiency, $\eta$, is defined as the ratio of power into the load, $R_L = R_K + 1/v$, and the total power incident upon the cavity entrance port. Thus $$\eta = \frac{R_S}{R_S + R_K + 1/v} \tag{1}$$

$$\text{At } v = 0 \quad \eta = 0, \text{ at } v \longrightarrow \infty \; \eta = \frac{R_S}{R_S + R_K}$$

-continued $$\text{The formula } \eta = \frac{R_S}{R_S + R_K + 1/v}$$

has two unknowns, $R_S$ and $R_K$. If efficiency is measured for two different values of $v$, the normalized values of $R_K$ and $R_S$ can be deduced.

Using subscript 1 for the first test and subscript 2 for the second test, one observes the following:

$$\eta_1 = \frac{R_S}{R_S + R_K + 1/v_1} \tag{2}$$

and $$\eta_2 = \frac{R_S}{R_S + R_K + 1/v_2} \tag{3}$$

These may be solved for $R_S$ and $R_K$ as follows:

$$R_K = \frac{\frac{\eta_1}{v_1}(1 = \eta_2) - \frac{\eta_2}{v_2}(1 = \eta_1)}{\eta_2 - \eta_1} \text{ ohms} \tag{4}$$

$$R_S = \frac{\eta_1}{1 - \eta_1}[R_K + 1/v_1] = \frac{\eta_2}{1 - \eta_2}[R_K + 1/v_2] \tag{5}$$

Generated power, $P_G$, is known, so the voltage, $V_i$ for a given load, $i$, in the analogous circuit of FIG. 1 can now be found and is given by $$V_i = \left[ P_G \left[ \frac{R_S(R_K + 1/v_i)}{R_S + R_K + i/v_i} \right] \right]^{1/2} \alpha \; E_i \tag{6}$$

The value of this voltage $V_i$ is significant in that it gives a representation that is proportional to the field strength $E_i$ (volts/meter) existing in the cavity for a particular $V_i$. Using equation (1) it is now possible to plot a theoretical curve of efficiency for any volume of load. Results from actual cavities under experimental conditions have been measured and so plotted and are found to compare very well with curves from the above derived equations.

If the coupled power per unit volume $P_L$ is correlated as set forth above by the equation $$P_L = \frac{P_G \eta}{v},$$

it can be shown that $$P_L = \frac{P_G R_S}{v(R_S + R_K) + 1} \tag{7}$$

Figure 2:
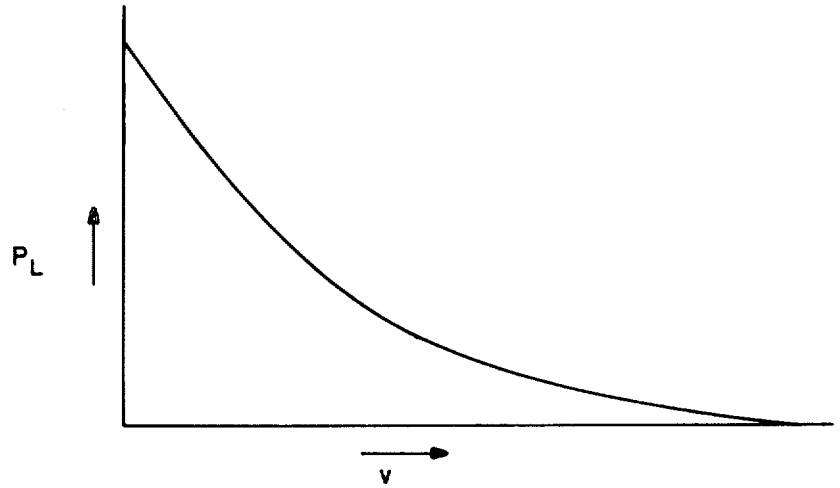
FIG. 2 is a graph depicting the energy dissipation (watts/liter) which occurs in a microwave oven as a function of the quantity —$v$— of food or material contained therein.
Figure 3:
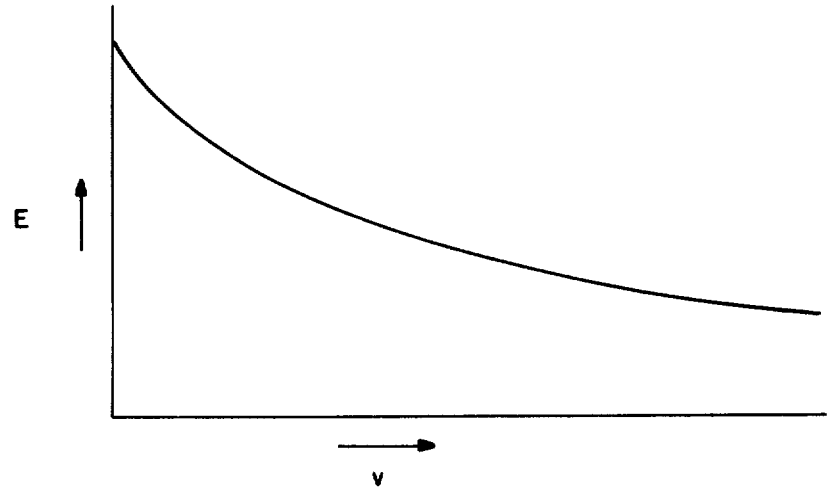
FIG. 3 is a graph depicting the electromagnetic field strength given by way of example as the E field as a function of the quantity —$v$— of food contained within the oven.

FIGS. 2 and 3 illustrate the character of equations (6) and (7) plotted in approximate relation to each other. It will be noted that the power coupled to the load proceeds to 0 as the load increases; whereas, the strength of the E field, for example in the cavity, approaches a finite value.

Figure 4:
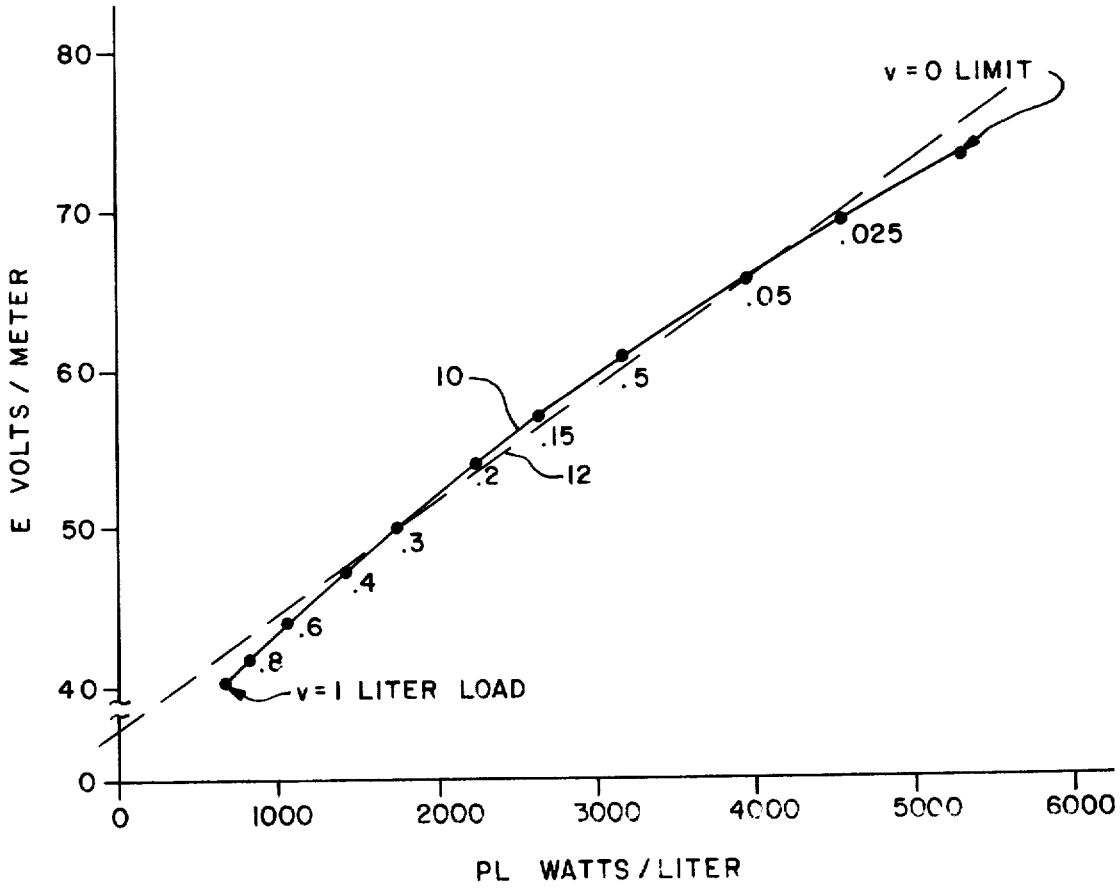
FIG. 4 is a plot of the electromagnetic field strength within the oven (as exemplified by the E field, in volts/liter) against the power delivered to the load P watts/liter, the load being varied from the no-load condition to a particular predetermined maximum level. This curve represents the simultaneous solution of equations which will be set forth in the following discussion, and is accompanied by a straight line, best fit approximation over the range of predicted performance, such straight line approximation serving as the basis for the present invention.

It will now be shown that the detected value of E can be adjusted to approximately track the value of $P_L$ so that an E field sensor can drive an electrical circuit to develop the time integral of the E field so that $$\int_0^t P_L\,dt \text{ (joules coupled/liter)}$$

can be made fixed regardless of variations in $v$ or $P_G$. To illustrate the point further, reference is made to FIG. 4 which is derived from the following typical values for a microwave oven $P_G = 1$ kilowatt $R_S = 5.333$ ohms $R_K = 1.333$ ohms From equation (7), the power coupled to the load is given by $$P_L = \frac{1000 \times 5.333}{1 + v(5.333 + 1.333)}$$

and the V computation proceeds by substitution of the aforegoing values into equation (6).

The following is a table of the values found from use of equations (6) and (7):

TABLE I

| v | $P_L$ | V(αE) |
|---|---|---|
| 0 | 5333 | 73.03 |
| .025 | 4571 | 68.74 |
| .05 | 4000 | 65.36 |
| .1 | 3200 | 60.26 |
| .15 | 2667 | 56.62 |
| .2 | 2286 | 53.78 |
| .3 | 1778 | 49.94 |
| .4 | 1455 | 47.23 |
| .6 | 1066.7 | 43.90 |
| .8 | 842.1 | 41.69 |
| 1.0 | 695.7 | 40.21 |

It will be noted that a plot of the foregoing values is shown varying from $v$=1 liter of load to the limit of $v$=0. It will be noted that the E field proceeds rather steadily from a given no-load value to a one (1) liter load value along a curved path 10 through which a good straight line approximation 12 can be made with a high degree of accuracy.

What the foregoing means is that: given a material to be heated and having a predetermined specific heat for an arbitrary $v$ and an initial temperature $T_1$, it is possible to reduce the problem of the time required to heat the material from temperature $T_1$ to a desired $T_2$ to the solution of an integral equation of the general form $$T_2 - T_1 = a \int_0^t (E(t,v) - b)dt$$

where all of the variables relating to the load in the oven to the quantity of the food and the power delivered to the oven and any other variable have been subsumed in the variable, E(t,v) (which exemplifies the strength of the electromagnetic field in the cavity at a position remote or spaced from the material being heated); the constant, $a$, is a proportionally constant which relates existing field strength to desired ΔT and can be used to adjust for variations in the character of the load; and, the constant, $b$, the minimum load condition in the oven. Experimental values of $a$ and $b$ can be developed and, once made, can be made permanent. The measurement information of the electromagnetic field strength and other oven conditions as exemplified by the function $E(t,v)$ in accordance with the generalized equation (8) and comparison thereof with a given demand value $T_2 - T_1$ can be used to solve the integral equation for the limit, $t$.

The value $T_2 - T_1$ can be modeled as voltage difference (electronically) while the strength of the function $E(t,v)$ can be determined by suitable sensing probe, the results of which are compared against a demand signal $(T_2 - T_1)$ after integration of $E(t,v)$. When that limit is reached, a comparator is used to trip power control relays to shut the oven off.

In summary, the method and apparatus for controlling the amount of electromagnetic energy delivered to a load in a microwave oven according to the present invention is characterized in that the electromagnetic energy applied to the oven creates a field having strength properties which are measured either electrically or magnetically at a position spaced from or remote from the load itself. By introducing arbitrary compensating variables, $a$ and $b$, in which the sensed field strength is reduced by the factor, $b$, to compensate for known maximum load conditions in which even the presence of a field is still insufficient to have any appreciable influence on the load, after which the strength of the field as a function of time is evaluated and integrated at a rate, $a$. The result is directly related to the energy per unit mass delivered to the load and is, therefore, used as a measure of the rise in temperature of the load. A suitable voltage deriving device establishes electronically a signal representing the initial temperature and the desired final temperature of the load. This difference is compared to the integrated and compensated result of the field sensing system and when the same are found to be equal, as in equation (8), a suitable circuit switches off the power supplied to the microwave oven. The electronic realization of circuitry to achieve this fit will now be described in conjunction with the following additional drawings:

FIGS. 1 through 4 have been previously described.

Figure 5:
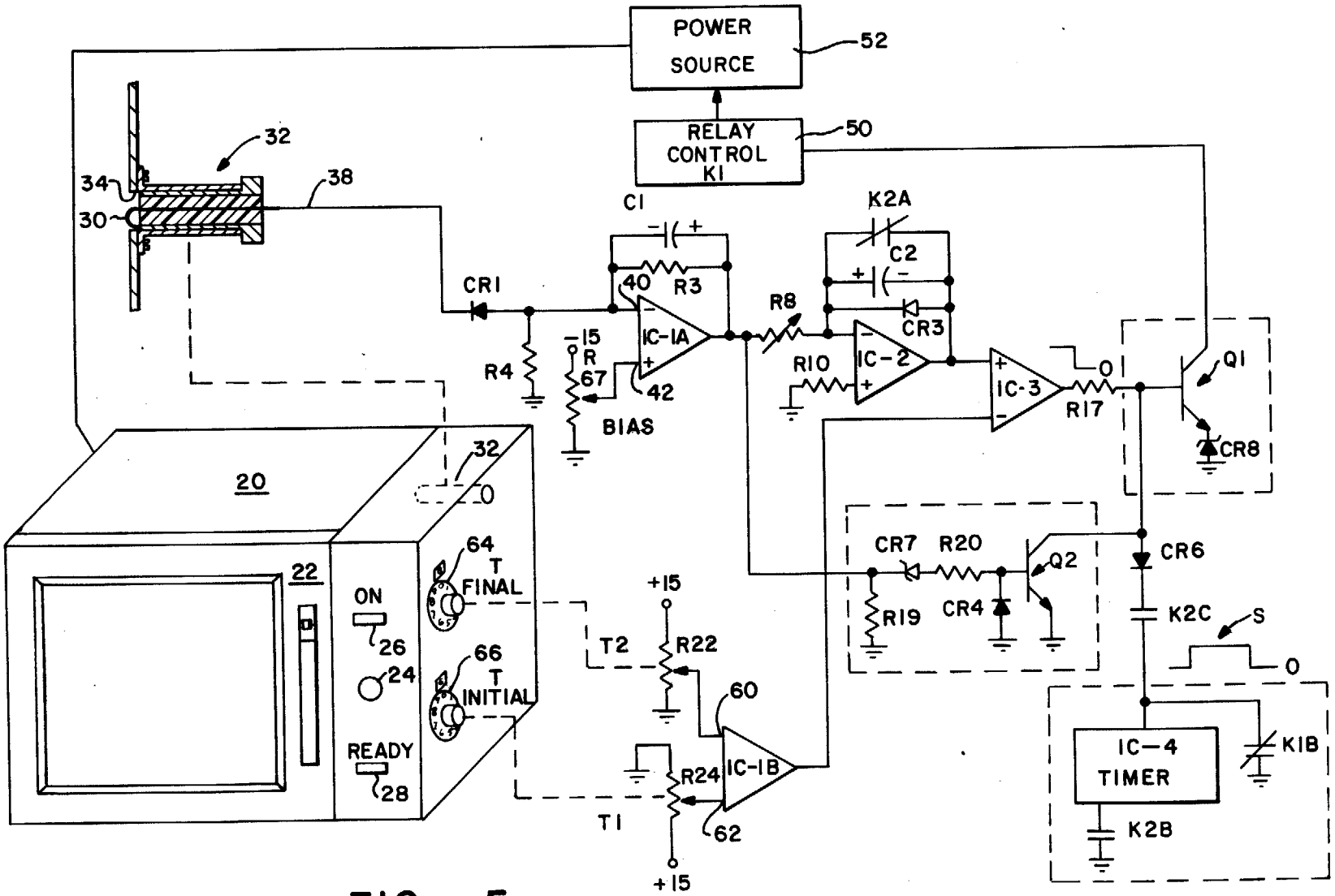
FIG. 5 will be described hereinafter in connection with the structural realization of the preferred embodiment.

FIG. 5 is a simplified electrical circuit representation of a microwave oven control apparatus constructed in accordance with the present invention.

DESCRIPTION OF THE PREFERRED EMBODIMENTS

Referring now particularly to FIG. 5, the invention is shown in relation to a microwave oven 20 which can be of any suitable type, such as a Litton Model No. 70/40, manufactured by Litton Industries, Inc. at Minneapolis, Minnesota. The same is equipped with an access door 22 which is openable for insertion of material, such as food, to be heated within the oven. The front plate of the oven as modified in the preferred embodiment is provided with a start switch 24, an "on" light 26 which gives light indication whenever the oven microwave power is applied, and a "ready" light 28 which comes on when the circuitry is ready to provide microwave power. In accordance with the present invention, the oven is provided with an electromagnetic field sensing probe remote from the load which can, by way of example, consist of a small loop probe 30 termination of a coaxial transmission line which is mounted within a coaxial fitting 32 of a known type. The loop probe 30 projects from the fitting in the neighborhood of an opening 34 in the wall of the microwave oven, as shown. The output of the probe sends a signal through a transmission cable 38 which is proportional to the strength of the electromagnetic field within the oven. This signal is applied through a video detecting diode CR-1 and across resistor R-4 to the input terminal 40 of a filtering amplifier consisting of IC-1A which is bridged by a capacitor C-1. This circuit (LC-1A, C-1, and associated components) serves to amplify and filter the output signal to prevent overload of subsequent stages. Essentially, IC-1A serves as an active filter to even out the input signal. The other input 42 of filtering amplifier IC-1A is connected to a source of voltage through an adjustable biasing resistor R-67, the output of which is variable. This resistor permits setting of the value of *b* in equation (8). The time constant of the filtering amplifier stage is determined by capacitor C-1 and an associate resistor R-3 together with the gain of the stage as a whole and as such to reduce the ripple appearing on the input signal to about 1% of its initial value. This allows a subsequent stage to operate within practical limits during peak excursion of the input signal.

The output of the active filter is applied to the input of an integrator IC-2 through a series variable resistance R-8. The purpose of R-8 is to control the speed or gain of operation of IC-2 and in this way control the value of the constant, a, as given in equation (8). R-8 is adjusted in accordance with the type of load which is placed in the microwave oven, the value of which is determined by experimentation. As previously suggested, the value of R-8, once determined, remains constant provided loads of similar character and specific heat are placed in the oven. This particularly applies to re-thermalization of foods from refrigerated temperatures, as in the reheating of foods taken from refrigerated vending machines.

The output of the integrator runs from a given reference value taken at 0 volts to another value depending upon the integral of the input signal as a function of time. The output of the integrator is applied to one input of a comparator IC-3, the other input of which is taken from the output of a reference demand signal as will be presently explained. The output of comparator IC-3 has only two states, either on or off, which in practice are either 0 volts or a given voltage, i.e. +5 volts. As will become more clear by way of further discussion, the initial value of IC-3 is +5 volts and remains so until the integrated output from IC-2 reaches the predetermined reference level, at which point the comparator switches to a 0 volt condition. Upon switching to the 0 volt condition (off), the output of IC-3 drives the base of Q-1 out of conduction, thereby causing a relay control 50 to turn off a power source 52, such as a microwave oven magnetron.

The reference signal which models the temperature difference $T_2 - T_1$ is derived from IC-1B and simply consists of a summation of the difference of input voltages applied to its input terminals 60, 62 as derived from resistors R-22 and R-24. Since the foregoing discussion has justified the modeling of the demand voltage temperatures by a straight-line, best-fit approximation, it is justified to use potentiometers R-22 and R-24 which are linear and which may be driven by suitably calibrated dial counters 64, 66 which read initial and final temperatures directly in units of degrees. Such (64,66) are indicated as located in an accessible position on the microwave oven. In certain applications, such as food vending re-thermalization, the initial and final temperatures will be completely determined and accessibility to such dials need not be made available. However, in other applications where the operator is permitted some latitude of selection, they may be made as readily accessible as desired. It is a particular advantage of the present invention that linear scale devices, such as the counters 64, 66 and linear potentiometers R-22, R-24, can be used as set controls of the present apparatus. IC-1B serves as a differential amplifier having two inputs with unity gain from stable voltage reference sources. Whenever the input voltage settings are the same, the output of differential amplifier IC-1B is 0 volts, but when the final temperature adjustment, as made with resistor R-22, is raised towards the +15-volt end, it makes an output of the differential amplifier IC-1B shift incrementally more negative than 0 potential. The output is variable then from 0 to −5 volts and serves as an adjustable reference for the comparator IC-3.

Means are provided for sensing a no-load condition in the oven for turning the same off so as to prevent arcing or other possible damage to the equipment when nothing is present in the oven. Such means consists of the Zener diode CR-7 tied in series to the base of transistor Q-2. Whenever the input voltage exceeds a predetermined level, as set by CR-7, the same will break down and drive Q-2 into conduction. This causes positive base drive to Q-2 and also serves to turn on that transistor and thereby turn off transistor Q-1 thereby opening the relay control to power source 52.

Means is provided for sensing a continuation of operation of the oven beyond a predetermined time interval. Such amount of time may, for example, in the re-thermalization of foods, be of the order to 10–12 minutes. Such means consists of IC-4 which serves as a timer and which also provides a high output signal over a time interval signal indicated at S over a sufficient time interval to accomplish the heating cycle for which the oven is adjusted, after which it shifts to a nearly 0 voltage state cutting off conduction of Q-1 and also causing shut-down of the oven.

Initial conditions are established by a series of relays which will now be described. K-2A is a relay contact which bridges the integrating capacitor of integrator IC-2. This contact is normally closed, but opens upon start command to thereby permit the integrator to begin its integration function from a zero reference. Relay contact K-2B is connected to a limit timer IC-4 and is normally open, but closes when high voltage power supply 52 is on, thereby starting the limit timer. K-2C is normally open, but closes at the beginning of the timing pulse thereby establishing a connection to the base of transistor circuit Q-1. Relay contact K-1B is normally closed and connected at the output of timer IC-4. It serves to remove the limit timer voltage when Q-1 is shut down by command of comparator IC-3, or whenever the high voltage is interrupted for any reason.

In the circuit diagram given, a number of components of an actual operating circuit have either not been given or have not been discussed in order since their employment or operation is derived readily discernable to those skilled in the art. Examples of suitable selection of characteristics for the major components are as follows:

| | |
|---|---|
| IC 1 | RC 4558 DN Raytheon |
| IC 2 | LM 307 N Raytheon |
| IC 3 | LM 311 N Raytheon |
| IC 4 | NE 555 V Signetics |
| K 1 | 62R2 - 12DC Sigma |
| K 2 | 68R3 - 120AC - SCO Sigma |
| K 10 | 68R3 - 120AC - SCO Sigma |

-continued

| | |
|---|---|
| Q 1 2N3904 | Motorola |
| Q 2 2N3904 | Motorola |

The following is an example of evaluation of the present invention conducted with a water load for 0.3 liters polyurethane cup filled to varying degrees with water and located in the center of a microwave oven and appropriate adjustments made to potentiometers R-67 and R-8. The following results were obtained in which $T_1$ is the setting of counter 64 which was made from measurement of the input water temperature. $T_2$ is the setting made to counter 64 and is the desired temperature to be reached. T observed is the measured temperature of the water after the oven was shut off and the water measured. It will be noted that these values are quite acceptably close to the desired demand temperature. There has, accordingly, been provided a method and apparatus herein for controlling the temperature rise in materials being processed in a microwave oven which is simple, direct, highly user insensitive, and which automatically compensates for changes in the quantity of a load placed in the oven. It is also capable of being adjusted to compensate for changes in the specific heat of a wide variety of materials.

| | .05L | .1L | .25L |
|---|---|---|---|
| $T_1$ | 23.1° C | 23.8° C | 24.1° C |
| $T_2$ | 60° C | 60° C | 60° C |
| T Observed | 59.4° C | 62.1° C | 57.3° C |

To those skilled in the art to which this invention pertains, many adaptations and modifications thereof will occur. For example, while the example herein of the best mode of carrying out the invention has related specifically to the first step of a re-thermalization of food process, it will be obvious that a multistep re-thermalization in which the power is cycled on and off in order to establish equilibrium temperatures, such as disclosed in the above referenced U.S. Pat. No. 3,854,022 to Moore, can be immediately applied to the present invention. Furthermore, while the present invention utilizes what is generally known as a loop probe to establish the field strength within the cavity, it would be possible to utilize any other form of sensor which can establish this field strength provided the output of the same can be converted into an electrical signal. Accordingly, the specific disclosure given herein should be taken as an example of the invention and not as a limitation thereon, except as set forth in the accompanying claims.

What is claimed is:

1. Method for controlling the temperature rise of material being heated in a microwave oven to which electromagnetic energy is applied comprising the steps of sensing the residual field strength of the electromagnetic field within the oven at a position outside of or remote from the material being heated, reducing the measured field strength by an amount sufficient to provide a reference value approaching zero reference level when said oven is maximumly loaded,, establishing an initial temperature $T_1$ of the material placed in said oven, selecting a final desired temperature $T_2$ of said material, comparing said temperatures $T_1$ and $T_2$ to develop a demand signal therefrom corresponding to the difference in temperature, integrating the sensed value of the intensity of said electromagnetic field as so reduced with respect to time and at a rate which corresponds to the power dissipation within the material within said oven to develop an integral signal increasing in time and correspondence with the temperature rise in said material, comparing the integral signal so derived with said demand signal and switching off the electromagnetic energy supplied to said oven when said integral signal reaches the value of said demand signal.

2. Method for controlling the temperature rise of material being heated in a microwave oven to which electromagnetic energy is applied comprising the steps of sensing the residual field strength $E(t,v)$ of the electromagnetic field within the oven at a position outside of or remote from the material being heated, reducing the measured field strength by an amount --b-- sufficient to provide a reference value approaching zero reference level when said oven is maximumly loaded, establishing an initial temperature $T_1$ of the material placed in said oven, selecting a final desired temperature $T_2$ of said material, comparing said temperatures $T_1$ and $T_2$ to develop a demand signal therefrom corresponding to the difference in temperature, integrating the sensed value of the intensity of said electromagnetic field as so reduced with respect to time in accordance with $$T_2 - T_1 = a \int_0^t [E(t,v) - b]dt$$

where $-a-$ is the rate corresponding to the power dissipation within the material within said oven to develop an integral signal increasing in time and correspondence with the temperature rise in said material, and $-t-$ is the time of operation of said oven, comparing the integral signal so derived with said demand signal and switching off the electromagnetic energy supplied to said oven when said integral signal reaches the value of said demand signal.

3. Apparatus for controlling the temperature rise of material being heated in a microwave oven to which electromagnetic energy is applied comprising means for sensing the residual field strength of the electromagnetic field within the oven at a position outside of or remote from the material being heated, means for reducing the measured field strength by an amount sufficient to provide a reference value approaching zero reference level when said oven is maximumly loaded, means for establishing an initial temperature $T_1$ of the material placed in said oven, means for selecting a final desired temperature $T_2$ of said material, means for comparing said temperatures $T_1$ and $T_2$ to develop a demand signal therefrom corresponding to the difference in temperature, means for integrating the sensed value of the intensity of said electromagnetic field as so reduced with respect to time and at a rate which corresponds to the power dissipation within the material within said oven to develop an integral signal increasing in time and correspondence with the temperature rise in said material, means for comparing the integral signal so derived with said demand signal and switching off the electromagnetic energy supplied to said oven when said integral signal reaches the value of said demand signal.

4. Apparatus as in claim 3 further including means for sensing a no-load condition within said cavity and for turning the same off in response thereto.

5. Apparatus as in claim 3 further including timing means for establishing a maximum time interval over which said cavity should operate and for supplying a signal for shutting down said cavity at the end of said interval.

* * * * *